US006230616B1

(12) United States Patent
Steuer

(10) Patent No.: US 6,230,616 B1
(45) Date of Patent: May 15, 2001

(54) STORAGE DEVICE AND ITS USE

(76) Inventor: Armin Steuer, Am Waldrand 30, D-71111 Waldenbuch (DE)

( * ) Notice: Subject to any disclaimer, the term of this patent is extended or adjusted under 35 U.S.C. 154(b) by 0 days.

(21) Appl. No.: 09/395,165

(22) Filed: Sep. 14, 1999

(30) Foreign Application Priority Data

Sep. 17, 1998 (DE) ..... 198 42 585

(51) Int. Cl.[7] ..... B41F 1/07

(52) U.S. Cl. ..... 101/23; 101/25; 101/225; 101/228; 101/DIG. 42; 242/419.3

(58) Field of Search ..... 101/23, 25, 27, 101/3.1, 32, 38.1, 232, 470, 228, DIG. 42, 225; 242/419.3; 400/234

(56) References Cited

U.S. PATENT DOCUMENTS

| | | | | |
|---|---|---|---|---|
| 3,827,358 | * | 8/1974 | Budai | 101/228 |
| 4,294,637 | * | 10/1981 | Rump | 101/470 |
| 4,640,191 | * | 2/1987 | Bradley | 101/470 |
| 4,641,771 | | 2/1987 | Masuch et al. | 226/115 |
| 5,010,816 | * | 4/1991 | Sarda | 101/232 |
| 5,611,272 | | 3/1997 | Steuer | 101/23 |
| 5,873,662 | * | 2/1999 | Clevinger | 400/234 |
| 5,979,308 | * | 11/1999 | Kägi et al. | 101/3.1 |

FOREIGN PATENT DOCUMENTS

| | | |
|---|---|---|
| OS 21 46 038 | 3/1973 | (DE) . |
| 24 16 323 c2 | 10/1974 | (DE) . |
| 44 11 936 A1 | 10/1995 | (DE) . |

* cited by examiner

*Primary Examiner*—Eugene Eickholt
(74) *Attorney, Agent, or Firm*—Nath & Associates PLL; Gary M. Nath; Harold L. Novick

(57) ABSTRACT

A storage device for receiving a loop section of a flexible material web (8) moved in a conveying direction (18) between a feed area upstream of the storage device and a discharge area downstream thereof is described, the material web speeds at least periodically differing from one another in the feed area and the discharge area. The speed differences are compensated by a length change of the loop section stored in the storage device. On the feed side the storage device has a first pulling device formed by a suction belt (35, 55) and on the discharge side a separate, second pulling device formed by a parallel suction belt (35, 56). As a result of the parallel suction belts the drawn-in loop section is securely held by vacuum over most of its length, whereas between the pulling devices a tensile force-free loop partial section (4*a*) is moved to and fro in the store longitudinal direction with substantially no shape change in accordance with the store filling. A rotary hot stamping machine is described, in which such storage devices can be used with particular advantage.

30 Claims, 3 Drawing Sheets

STORAGE DEVICE AND ITS USE

Figure 1:
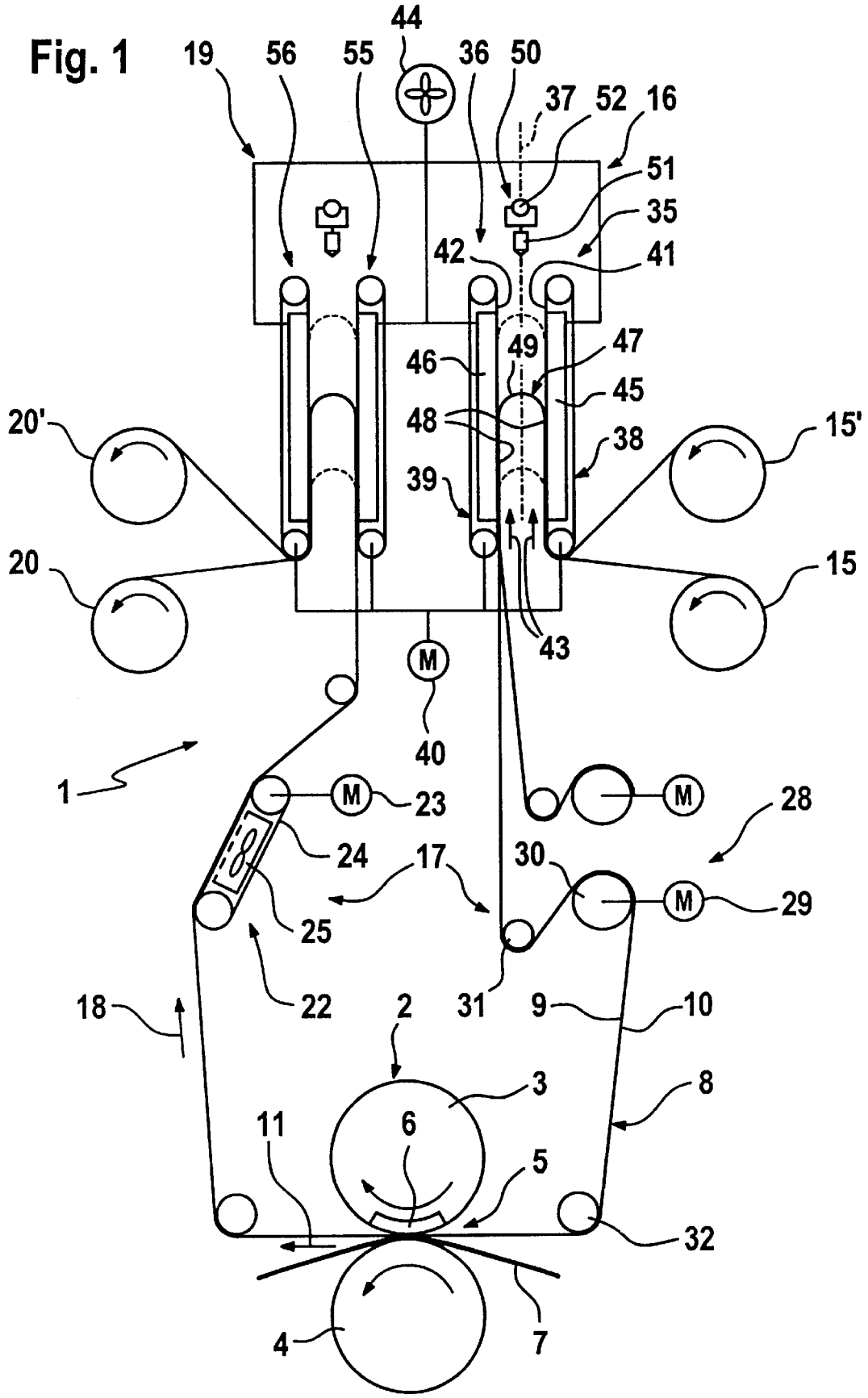

The invention relates to a storage device for receiving a loop section of at least one moving, flexible material web, particularly an embossing or stamping film web, between a feed area upstream of the storage device in which the material web is moved with a feed web speed, and a downstream discharge area, in which the at least one material web is moved with a discharge web speed at least periodically differing from the feed web speed.

In the manner of equalizing tanks or material buffers, such storage devices can be used in an apparatus for processing material in the form of at least one flexible material web for separating from one another at least periodically differing material web speeds. The adaptation of the different speeds can take place in that the storage device receives a material web loop section of varying length and in this way compensates speed differences between the feed side and the discharge side, without there being any compression or inadmissible tensile stressing of the material web.

Known storage devices of this type have a vacuum tank into which is sucked a loop section of the material web. At the entry area of the vacuum tank the loop section is held at two points, e.g. on guide pulleys, whilst the intermediate loop section is kept taut by vacuum. The loop section sucked into a more or less deep level acts in the manner of a piston, whilst the associated cylinder is formed by the smooth tank walls. To avoid the drawing in of secondary air, the tank walls facing the web edges must be as close as possible to the border of the material web, so that the width of a vacuum chamber appropriately only slightly exceeds the width of the stored material web. As the suction chamber width must be very accurately adapted to the material web width, on changing from one material web width to another storage devices have to be correspondingly replaced or converted, in that chamber walls are manually moved in order to adapt the chamber width to the width of the new material web. Such vacuum stores are e.g. known from European patent applications 176 905 or 623 432 and have proved satisfactory with relatively stiff or hard material, such as paper or photographic film material. EP 718 099 discloses that such vacuum stores can also be used as film stores for storing stamping film web sections in a rotary stamping machine. With relatively thin, sensitive embossing film material increased constructional and/or control costs may be needed to avoid damage to the film material. With inadequate web tension there can be fluttering of the very light, flabby film material in the air flow of the sucked in air, so that an embossing film web can be damaged and/or the drawing in force of the storage device can be uncontrollably impaired.

The problem of the invention is to provide a storage device obviating the disadvantages of the prior art. The storage device is in particular to permit a problemfree storage of thin, sensitive stamping film material, optionally in several parallel material webs.

To solve this problem the invention proposes a storage device having the features of claim 1.

In a storage device according to claim 1 of the invention there is on the feed side a first pulling or drawing device for pulling or drawing the at least one material web towards the storage device and on the discharge side a separate, second pulling or drawing device for pulling or drawing the material web towards the storage device. Between the pulling devices to act on one another or opposite to one another with respect to the web running direction and which over a considerable part of the length of the loop section can engage in flat, protective manner thereon, there is a free loop partial section, which is substantially free from tensile forces. It can be very short compared with the total length of the loop section and can remain quiet and flutter-free due to the inherent tension of the material web. The loop partial sections adjacent to the free loop partial section and on which the pulling devices engage in flat manner, can be actively kept spaced apart by the pulling devices. As a result it is in particular possible to avoid the risk of a mutual contact between these loop legs or sides, e.g. due to electrostatic forces. This risk can arise in the case of vacuum stores, in which the total loop section length is unguided or free and corresponding to the loop shape from the interaction between the web tensile forces and by vacuum sucking in forces occur.

A preferred embodiment is characterized in that the first pulling device and/or the second pulling device has at least one preferably sectionwise, planar driving surface movable on a drawing in direction and pressure means for the flat pressing of the material web onto the driving surface. The tensile force of a pulling device can consequently be transferred carefully to the at least one material web over a large or elongated surface area. Through the engagement on the spaced driving surfaces, the corresponding loop legs can be actively and reliably kept apart. Preferably a slip drive is formed between the at least one material web and driving surface accompanied by the building up of sliding friction. The building up of sliding friction whilst avoiding static friction encourages a gentle, jerk-free and material web-protecting conveying thereof and can appropriately be achieved in that the speed of the driving surface in the pulling in direction is higher than the material web speed in this direction predetermined by the conveying means. Preferably the first pulling device and/or second pulling device has at least one circumferential conveyor belt forming the driving surface with in each case one planar section of its outer surface.

In order to produce the necessary pressing of the at least one material web on the driving surface, preferably the pressure means incorporate a suction device for sucking the at least one material web onto the driving surface and which produces a vacuum between the material web and the driving surface.

Alternatively or additionally it is also possible, e.g. by means of a fan and using an air flow, to press the at least one material web from the driving surface-remote side onto the driving surface. Preference is given to such contactless operating pressure means as a result of the material web protection obtained. Such an air flow can in particular be provided by a blower or fan rail, which is located between the two pulling devices and runs transversely to the feed direction of the at least one material web in this area. The at least one material web is passed between the fan fail and the two pulling devices. The air flow passes out of the fan rail in the direction of the two pulling devices, so that the at least one material web is pressed onto the pulling devices. The use of a fan rail is particularly advantageous if several, possibly differently wide material webs are to be intermediately stored in the same storage device. There is no need to provide guide faces engaging closely on the material web in order to maintain the pressure difference between drive face-remote blowout side of the fan rail and drive face-facing side of the pulling devices. This inter alia reduces the changeover times if it is necessary to pass through the storage device new material webs having a different width. In the simplest construction the pulling devices are then constructed as fixed side walls on which the at least one material web engages and along which it slides. The pressure means can also have pressure elements operating by means of contact, e.g. pressure brushes or the like.

For a particularly careful and simultaneously reliable guidance of the at least one material web in the storage device, use is advantageously made of means for adjusting the tensile force for the first pulling device and/or the second pulling device, by means of which e.g. as a function of the average conveying speed in the main conveying direction and/or the material web material the tensile forces can be optimized. A control of the intensity of the sliding friction between the material web and the driving surfaces can e.g. take place by means of the feed speed of the conveyor belt and/or by means of the suction force of the suction unit and/or the air flow of the fan rail.

A preferred embodiment is characterized in that the driving surfaces of the first pulling device and second pulling device face one another and/or are substantially parallel to one another. The driving forces can consequently act as walls movable in the drawing in direction, between which the loop section passes in roughly U-shaped manner with substantially straight legs. A spacing between the driving surfaces determining the spacing of the loop legs can appropriately be chosen sufficiently large for the free loop partial section in which the at least one material web engages on no driving surface, is maintained by the inherent tension of the material and the material is exclusively elastically curved in crease-free manner. However, optionally the spacing can be chosen so small that changes to the speed differences between the feed and discharge area are rendered noticeable in a clear displacement of the free loop partial section within the storage device parallel to the drawing in direction and which can be reliably detected by a sensor means.

The storage capacity can be designed in such a way that there is adequate storage space for all operating conditions and there is neither an overfilling, nor a complete emptying of the store. Preferably, however, the degree of store filling is monitored, in order optionally on the feed side and/or discharge side to carry out material web speed changes by a corresponding control of the web conveying means. In a preferred embodiment a sensor means is provided for detecting the store filling and has at least one proximity or spacing sensor for detecting a spacing between a free loop partial section and a reference position in particular measured parallel to the drawing in direction. A proximity sensor not only permits an easy detection of the absolute filling level or degree of a storage device, but in particular also a problem-free detection of the dynamics of store filling, i.e. a detection of the speed at which the store fills or empties. It is also possible for one or both pulling devices to be made from transparent material, e.g. a translucent film, which is passed around two rollers and runs in a circle and at least one of the two rollers is driven and which is transparent in the area between the two rollers and to detect the position of the at least one material web by means of a camera, which is located on the material web-remote side of the transparent pulling device. This is particularly advantageous if the position of several material webs is to be simultaneously monitored in the same storage device. The detection of the store filling dynamics permits an "anticipatory" control of the material feed and/or material discharge with respect to the storage device, so that not only on reaching a permitted, maximum filling level are corresponding control signals emitted to a control unit and instead this occurs on rapid approach to an extreme state of the store filling.

A preferred, contactless operating sensor means is characterized in that it has at least one wave generator for generating electromagnetic and/or sound waves and that preferably at least one receiver is provided for receiving the waves reflected by the free loop partial section. In particular, the spacing measurement can be carried out with the aid of at least one laser light source and in particular at least one photodiode can be used as the receiver. In the case of spacing measurement by means of waves, the speed of filling or emptying of the storage device can be particularly easily derived and taken into account when use is made of the Doppler effect. In order to obtain a higher productivity, it is frequently desirable to process several material webs in parallel in an apparatus using the material web material. A corresponding storage device can preferably be constructed for storing several parallel, preferably independently movable material webs. Whereas in conventional vacuum stores it is necessary to provide for this purpose suitably spaced partitions between the individual material webs, so as to ensure a reliable sucking in whilst avoiding the drawing in of secondary air, this is unnecessary with the storage devices according to the invention, because in particular a pulling device with slip drive can simultaneously pull on several material webs optionally moved at different speeds and optionally the speed differences between a driving surface and the pulled material web can differ between individual webs.

Although it is possible to provide for each material web a separate sensor means for detecting the store filling, it is particularly advantageous if the sensor means is movable between the material web areas for the time-succeeding detection of the store filling in the case of at least two parallel material webs movable in parallel and preferably independently of one another. This measure which is not only advantageous in the case of stores according to the invention, but also in conventional storage devices, e.g. suction air stores, saves with respect to the hardware used, i.e. the sensor means, costs and constructional expenditure, because optionally a single sensor can be used for monitoring several material webs. A sensor is appropriately linked in signal-transmitting manner to a control and evaluating unit, by means of which it is possible to control on the feed side and/or discharge side the material web speed. In the case of several material webs monitored by one sensor, the association of the filling level measured values, particularly the spacing measured values, can be inexpensively carried out by corresponding software within the control device.

Storage devices of the aforementioned type can be used in all apparatuses, where it is necessary to store sections of material webs passing through, e.g. in printing presses, packing machines, embossing or stamping machines, etc. Since both on the introduction side and on the discharge side material can be drawn into the storage device under a suitable tensile force, it is possible to simply compensate at all times even complicated speed conditions between the feed and discharge sides. For example, on the feed side material can be continuously supplied and on the discharge side is removed intermittently or at varying speed. It is also possible to adapt a discontinuous material supply to a discontinuous or continuous material discharge.

With particular advantage storage devices according to the invention can be used in embossing or stamping devices, particularly hot stamping devices. Such a stamping device has a stamping press, in which between a stamping cylinder and an impression element, particularly an impression cylinder, a stamping gap is formed. There is also a conveying means for conveying a stamping film web from a film supply through the stamping gap to a film collecting device, the conveying means having film accelerating means constructed in such a way that, at least during a stamping interval, the stamping film web is moved at the same speed as a material layer to be stamped through the stamping gap. This is necessary so that the stamping material, e.g. discreet, succeeding stamping units, such as images or texts, or also part of a colour layer to be stamped, can be transferred in undistorted or unblurred manner to the material layer to be stamped and consequently the stamping film web does not tear during the stamping interval. A stamping device according to the invention is characterized in that between the film supply and the film acceleration means and/or between the film acceleration means and the film collecting device there is at least one storage device of the above-described type.

In the case of stamping film webs with discreet stamping units the aim is an optimum registration stability, i.e. a positional precision of the stamping unit with respect to the intended stamping location. With stamping films having colour layers, in order to minimize waste with respect to unused colour layer areas, the aim is a minimum spacing between successive colour layer areas to be stamped with respect to preceding colour layer areas already removed by stamping. To save material, the aim is that succeeding colour layer areas to be stamped or stamping units are closer together on the stamping film web than successive stamping locations on the material layer. This makes it necessary to guide the stamping film web outside the stamping interval more slowly than the normally uniformly moved material layer, acceleration taking place to the material layer speed prior to the stamping interval, followed by deceleration and optionally also drawing back. These speed changes are brought about by the film accelerating means, the term film acceleration covering both a speed increase and a speed decrease, as well as a direction reversal of the movement of the stamping film web. In a preferred embodiment the film accelerating means are constructed for producing a non-uniform movement of the material web, preferably for producing a forward/reverse movement, in which the material web is periodically moved in a reverse direction opposed to the main conveying direction. The advantages of inventive storage devices are then particularly apparent, because through the possibility of a bilateral, independent drawing in of web material into the film store as well as the possibility resulting from slip of drawing out from the storage device in substantially distortion-free manner counter to the drawing in direction, it is also possible to accommodate with problem material web movements counter to the main conveying direction.

Particularly in the case of a reverse movement of the material web, store filling problems can arise on the film accelerating means feed side, if material is constantly resupplied by the film supply. Thus, in a preferred embodiment, the film supply, which preferably comprises an unwinding storage roll for the stamping film web, is controllable with regards to the stamping film delivery rate. The control can in particular take place as a function of the filling level and/or the filling speed of the storage device downstream of the film supply and said control quantities are advantageously detectable by means of the described sensor means.

These and further features can be gathered from the claims, description and drawings and the individual features, both singly and in the form of subcombinations, can be implemented in an embodiment of the invention and in other fields.

An embodiment of the invention is described in greater detail hereinafter relative to the drawings, wherein show:

FIG. 1 A diagrammatic side view of an embodiment of a rotary stamping machine equipped with storage devices according to the invention.

Figure 2:
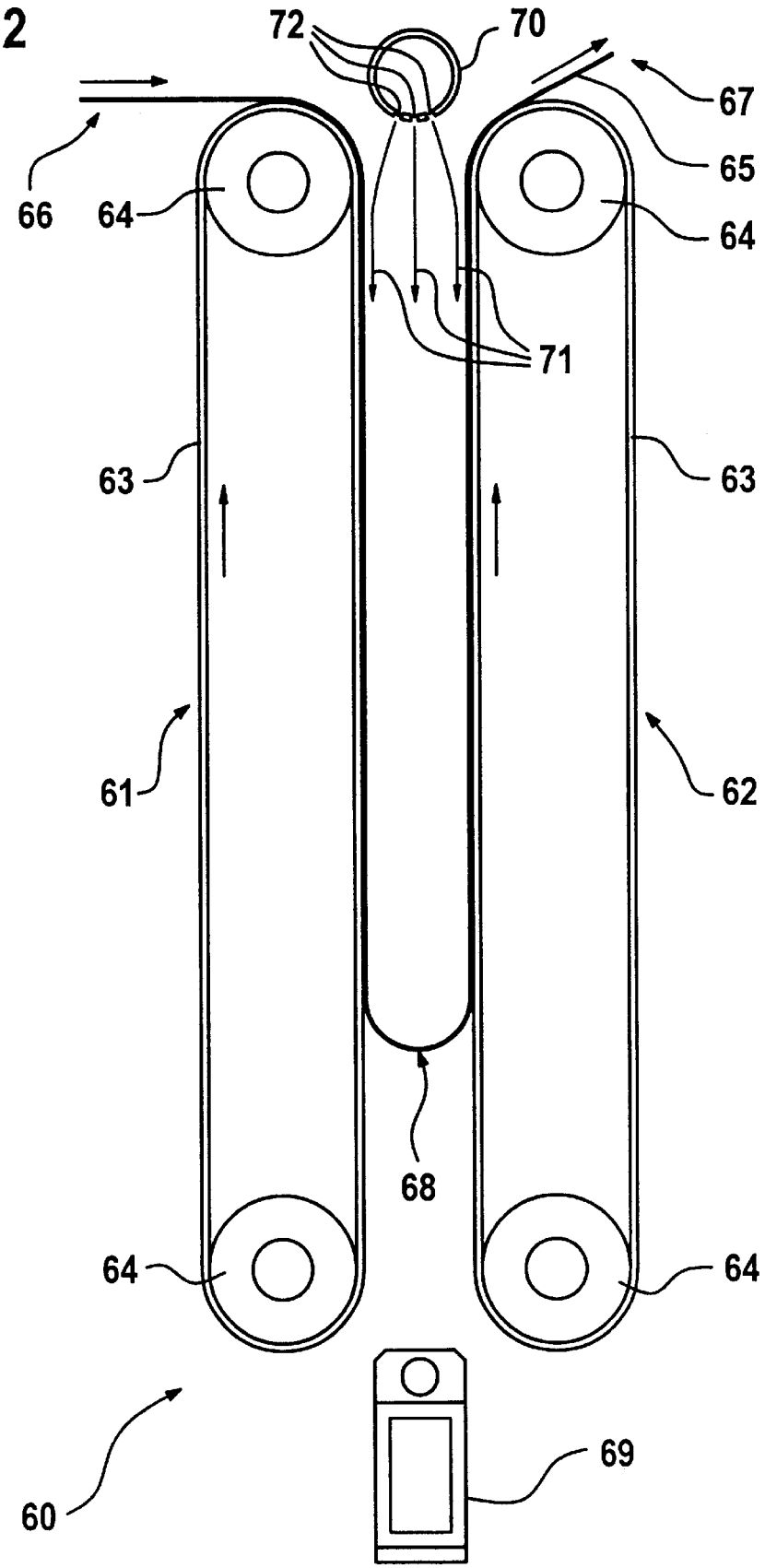

FIG. 2 A diagrammatic representation of a cross-section through a storage device according to the invention.

Figure 3:
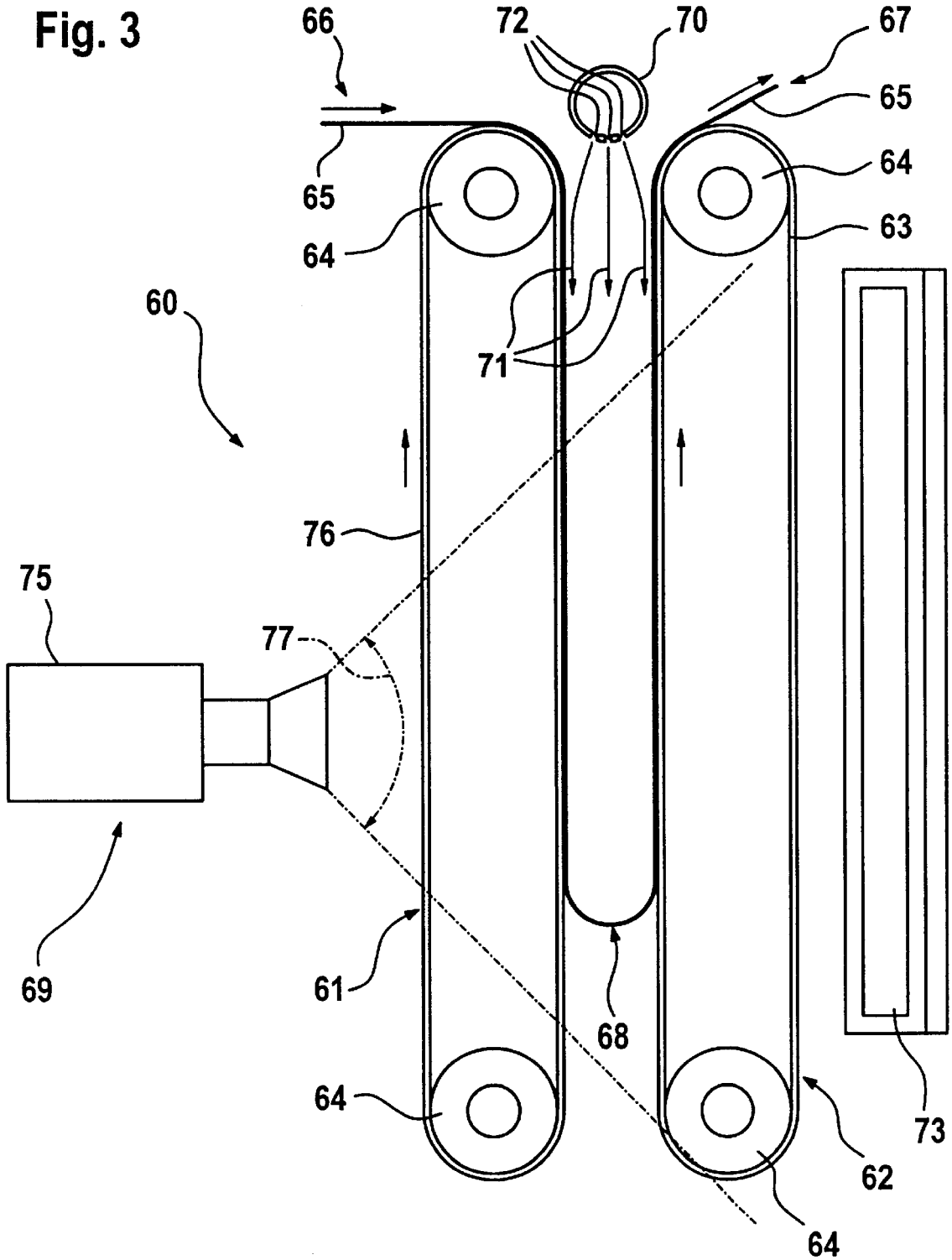

FIG. 3 A diagrammatic sectional view of a storage device according to the invention with a camera for determining the position of the storage webs.

FIG. 1 diagrammatically shows a rotary hot stamping machine 1, which can e.g. be used for stamping successive sheets or a web of paper, cardboard or plastic with stamping material present in a transfer layer of a stamping film web. The rotary machine has a stamping press 2 with a horizontal stamping cylinder 3 and a roughly equally large impression cylinder 4, located below it and between which is formed a stamping gap 5. Along its circumference, the stamping cylinder 3 has at least one heatable stamping die 6, which in the represented position during a stamping interval stamps on a material layer 7 one of the stamping units present on the stamping film web 8. The stamping film web 8 has a back 9 facing the stamping cylinder 3 and a sensitive front 10 having a layer of a thermally activatable hot-melt adhesive. FIG. 1 shows the device during a stamping interval, during which the material layer 7 and stamping film web 8 have in the vicinity of the stamping gap 5 the same movement direction 11 and run at the same speed through the stamping gap which corresponds to the circumferential speed of the contrarotating cylinders 3, 4.

The material web of the as yet unconsumed stamping film is located in a film supply 15 in the form of an unwinding storage roll, which is rotated by means of a not shown, speed-controllable motor, but in other constructions can also be passive or not driven. From the film supply the stamping film is passed in loop-like manner through a subsequently explained film feed storage device 16 to a film accelerating device 17, which controls both the speed and the direction of the stamping film movement in the stamping gap 5. In the main conveying direction 11 behind the film accelerating device is provided a film discharge storage device 19, through which the stamping film web is drawn in loop-like manner to a winding-up storage roll 20 serving as a film collecting device for the consumed stamping film web and which is drive by a not shown electric motor in the pulling direction at a uniform rotary speed. The superimposed storage rolls 15, 15' or 20, 20' indicate that the rotary hot stamping machine 1 is designed for the processing of several parallel-guided stamping film webs, whose film conveying is separately controllable.

The construction of the film accelerating device 17 is similar to that described in EP 718 099, whose features are made by reference into subject matter of the present application. The film accelerating device has a pulling or drawing device 22 following the stamping gap 5 in the conveying direction 18 with a circumferential suction belt 24, which is driven by means of an electric motor 23 at a uniform speed and whose top facing the stamping film web 8 moves in the conveying direction 18. In the conveyor belt 24 are provided through perforations, which are so dimensioned and arranged that they are covered groupwise by the stamping film webs engaging on the planar contact surface, as a function of the width thereof. All the parallel-guided stamping film webs pass over the same suction belt. Preferably the pulling device 22 operates in the sliding friction area between suction belt and stamping film web, which is brought about in that the suction belt 24 moves faster in the conveying direction 18 than the stamping film web. Thus, the pulling device produces a permanent tension on the stamping film web in direction 18, but also permits a movement of the stamping film web counter to direction 18.

Upstream of the stamping gap 5 is provided a film supply-controlling film feed device 28. A drive motor 29 programmable with respect to the rotation direction and speed, drives a control roller 30 controllable in accordance with the rotation speed and/or direction, by means of which the stamping film web 8 is so guided by means of upstream or downstream guide pulleys 31, 32, that the control roller is looped over roughly half its circumference by the stamping film web. The control roller in rolling contact with the stamping film web is constructed as a suction roller, which has suction openings acting in the looped area, through which the stamping film web is sucked in slip-proof manner, accompanied by the building up of static friction. A strong adhesive contact to the control roller suitable for driving the stamping film web and in particular adequate with respect to the tensile force of the pulling device is produced, without any contact with the sensitive front 10.

The film accelerating device 17 in particular permits a very advantageous forward/reverse operation of the stamping film web, which is particularly advantageous for film material economy purposes. As stated, the stamping film web is so accelerated that it runs through the stamping gap at the same speed as the material web 7 during the stamping interval. Following the stamping interval the material web is decelerated by decelerating the control roller 30 and by a directional reversal of the control roller 30 a portion is drawn back through the stamping gap in order to produce an adequate "starting distance" for the acceleration of the next stamping unit to the passage speed through the said gap necessary during the stamping interval. Thus, in the vicinity of the film accelerating device 17, there are both fast and slow web movements in the conveying direction 18, as well as fast and slow material web movements counter to said main conveying direction.

However, the material supply from the supply 15 and the material removal to the wind-up roll 20 generally take place with a different and optionally continuous web speed. The resulting web speed differences between the supply 15 and accelerating device 17 or between the accelerating device 17 and the collecting device 20 are compensated by the storage devices 16 or 19, which act as a buffer between the film supply 15 and film accelerating device 17 or between the film accelerating device 17 and film collecting device 20.

The construction of a storage device will be explained using the example of the feed storage device 16, on whose feed side prevails the feed web speed given by the unwinding speed of the storage roll 15, whereas on its discharge side prevails the web speed in the film accelerating range 17 varying as regards amount and direction with the cycle of the stamping intervals. On its side facing the film supply 15, the storage device 16 has a first pulling device 35 in the form of an elongated suction belt and on its discharge side facing the film accelerating device 17 a second pulling device 36, which is also formed by an elongated suction belt. The two suction belts 35, 36 have an identical construction, arranged with their longitudinal axes parallel to one another homologous to a broken line-indicated median plane 37 and have a mutual spacing perpendicular to the median plane. Each of the pulling devices has a perforated conveyor belt 38 or 39 revolving around two guide pulleys, the conveyor belts being so contra-rotated by a common motor 40 that their facing, planar driving surfaces 41, 42 are moved at the same speed in the upwardly directed drawing-in direction 43 (arrows) from the lower drawing-in opening. Between the straight portions of the conveyor belts are in each case provided vacuum boxes 45, 46 connected to a common suction fan 44 through which the air can be sucked through perforations provided in the conveyor belts. The width of the conveyor belts 38, 39 corresponds to a multiple of the film web width, so that several, spaced stamping film webs guided through the storage device can be jointly drawn into the store.

A U-shaped loop section 47 received in a storage device has two parallel, straight loop sides or legs 48, which are reliably guided over their entire length by the suction belts 35, 36 and are kept mutually spaced, in that they are drawn onto the driving surfaces moved in direction 43, as well as a normally short, compared with the loop legs, curved, free loop partial section 49, which is not in contact with the suction belts, but can instead move to and fro in accordance with the feed and discharge side speed conditions parallel to direction 43 in the area between the broken line-indicated positions of maximum or minimum store filling.

On the end side opposite to the drawing-in opening, in the vicinity of the median plane 37, is provided a sensor means 50 for detecting the store filling. The diagrammatically represented sensor means 50 has a sensor head 51, which is directed into the gap between the pulling devices 35, 36 and is so displaceable on a rail 52 moving perpendicular to the paper plane and transversely to the parallel stamping film webs, that the sensor head 51 successively detects the particular filling state for the juxtaposed film webs. The sensor head has a laser light source directed onto the centre of the U-bent, free loop partial section 49 and at least one photoelectric cell, which detects the light reflected in this area by the film web back 9. An associated evaluating device determines therefrom the longitudinal spacing between the free loop partial section and the sensor head serving as a reference point. Particularly if the spacing measurement is performed over a suitable time interval, in which e.g. the sensor head is briefly stopped over the particular film web to be measured, it is possible to derive from the time development of the spacing also the filling or emptying speed of the store prevailing for the particular stamping film web. The speed can also be derived from the filling levels of time-defined, successive, web-related individual measurements. The sensor head can be continuously moved for this purpose.

The film removal or discharge storage device 19 has an identical construction, its pulling devices 55, 56 being driven at the same speed as the pulling devices 35, 36 using the same motor 40 and the vacuum boxes associated with the suction belts are connected to the common suction fan 44. Unlike in the case of the feed-side storage devices, on the feed side 55 is in this case provided a non-uniform belt advance with forward/return movement resulting from the film accelerating device 17, whereas on the discharge side 56 there is a uniform conveying away to the winding-up storage roll 20.

FIG. 2 diagrammatically shows a section through a storage device 60 suitable for use as a film feed storage device 16 or a film discharge storage device 19. The storage device 60 is formed from the two pulling or drawing devices 61, 62 and the blower or fan rail 70. The at least one material web 65 is supplied on the feed side 66 of the storage device 60 and leaves the latter at the discharge side 67. Each of the two pulling devices 61, 62 comprises a pair of rollers 64, whereof at least one is driven, and a conveyor belt 63. The conveyor belt 63 runs round the two pulling device rollers 64. The running direction of the conveyor belt 63 corresponds to the feed-side pulling device 61 corresponds to the material web conveying direction, whereas the running direction of the discharge-side pulling device 62 is opposed to the conveying direction of the material web 65. Due to the fact that there can be a relative speed between the material web 65 and the conveyor belts 63 of the pulling devices 61, 62 the conveyor belt 63 must have characteristics such that there is no damage to the material web 65 as a result of this relative movement. A fan rail 70 is located between the rollers 64, which are located at the feed/discharge side at the pulling device 61/62. The width of the fan rail 70 extends over the width of the conveyor belts 63 and therefore determines the width which the at least one material web 65 can have in order to be conveyable through the storage device 60. Over its entire width the fan rail 70 has air exit ports 72 out of which passes the air flow pressing the material web on to the conveyor belts 63 of the pulling devices 61, 62. As a result of the air flow 71 the material web 65 is pressed onto the conveyor belts 63 in such a way that the material web 65 is moved into the storage device and a uniform tension is exerted, which results from the flow rate of the air flow 71, the movement speed of the conveyor belts 63 and the friction between conveyor belt 63 and material web 65. Through a suitable material selection for the conveyor belts 63 and by a coordination of the rotational speed of the conveyor belts 63 in the pulling devices 61, 62 and the flow rate 71 of the air flow it is possible to guide the material web in damage-free manner in the vicinity of the storage device 60. Different material web speeds between the feed side 66 and discharge side 67 can be compensated. It is not necessary for the rotational speed of the conveyor belts 63 of the pulling devices 61, 62 to correspond to one another. It can in fact be favourable to adapt the rotational speed of the conveyor belt 63 of the pulling device 61 on the feed side 66 as closely as possible to the speed of the material web 65 on the feed side 66.

In order to keep at a minimum the relative speed between the conveyor belt 63 and the material web 65 for the pulling device 62 on the discharge side 67, the rotational speed of the conveyor belt 63 of the pulling device 62 must also be kept low. The lower said speed, the more the air flow 71 has to act on the material web 65 in the direction of the gap between the pulling devices 61 and 62. The intensity of the air flow 61 is limited by the material characteristics of material web 65. A part is also played by the width of the at least one material web to be conveyed through the storage device 60, such as the inherent rigidity of the web 65. Thus, when coordinating or matching these factors, a suitable compromise must be chosen with regards to the specific circumstances.

The air exit ports 72 of the fan rail 70 can be constructed in different ways. They can e.g. be air exit holes or slots. The air exit ports 72 must be designed in such a way that in the area between the pulling devices 61, 62 there is a uniform, laminar air flow. In addition, the air flow must not only be directed onto the gap between the pulling devices 61, 62, but also towards the conveyor belts of the pulling devices in order to obtain an adequate force for pressing material web 65 onto the conveyor belts 63.

On the side of the pulling devices 61, 62 remote from the material web feed or discharge side is provided between the same a detection device 69, which determines the spacing with respect to the free loop partial section 68 of material web 65 between pulling devices 61, 62. If several material webs 65 are simultaneously stored in the storage device 60, the detection device 69 is then preferably constructed in such a way that it either simultaneously determines the spacing from the free loop partial section 68 of each material web or does this cyclically and successively at an adequate speed. For this purpose it may be necessary to provide several spacing measurement sensors in the detection device 69.

FIG. 3 shows another exemplified construction of a storage device 60, which is also essentially formed from two pulling devices 61, 62 and a fan rail 70. Unlike in the case of the storage device of FIG. 2, the pulling device 62 on the discharge side 67 of the at least one material web 65 additionally has a suction box 73. The at least one material web 65 is supplied to the storage device 60 on the feed side 66. The air flow 71 produced by the fan rail 70 results in the material web being pressed onto the conveyor belt 76 of the pulling device 61. The conveyor belt 76 of the pulling device 61 like the conveyor belt 63 of the pulling device 62 moves parallel to the air flow direction. As a result the at least one material web 65 is moved together with the conveyor belt 76 until as a result of the web speed on the discharge side 67, the material web 65 cannot be drawn out of the storage device 60. In order to bring about an improved guidance of the material web 65 at the conveyor belt 63 of the pulling device 62 on the discharge side 67 of said web 65, on the side of the pulling device 62 remote from the web 65 is provided a suction box 73. By means of the suction box 73 air is sucked through the air-permeable conveyor belt 63, so that there is an increase in the pressure difference between the air pressure in the vicinity of the air flow 61 and that of the side of the conveyor belt 63 remote from the material web. The increase in the pressure difference corresponds to an increase in the pressing force of the material web 65 onto the conveyor belt 63 of the pulling device 62. This measure can also contribute to reducing the relative movement between the conveyor belt 63 of the pulling device 62 and the at least one material web 65. A relative speed exists between the conveyor belt 63 and the at least one material web 65 because the movement direction of the conveyor belt 63 is in opposition to the movement direction of the material web 65 along the conveyor belt 63.

In order to ensure a uniform application of the air flow 71 to the material web 65, it can be advantageous to supply blowout air to the fan rail 70 at several points. The fan rail 70 can also be subdivided into a number of segments and each segment can have its own air supply, so that the air flow 71 passing out of the air exit ports 72 of the fan rail in the direction of the material web 65 can differ on each segment. This can e.g. be advantageous if in the storage device 60 are intermediately stored several material webs 65 with different characteristics.

On the side of the pulling device 61 remote from the material web 65 is provided as the detection device 69 for the free loop partial section 68 of the material web 65 a camera 75. So that the camera 75 can determine the position of the free loop partial section between the two pulling devices 61 and 62, the conveyor belt 76 is transparent. The camera must be so positioned as a function of its observation aperture angle 77 that it can determine the position of the free loop partial section 68 of the at least one material web 65 between the rollers 64 of the conveyor belt 63 or the transparent conveyor belt 76. The camera can also have in the extension direction of the fan rail 70 such an aperture angle of such a spacing from the transparent conveyor belt 76 that the entire width in the at least one material web 65 can be guided. Therefore the camera is in a position to simultaneously determine the location of the free loop partial section 68 of several material webs 65. By means of a suitable, not shown image evaluation device it is consequently possible to evaluate the position and position change of the free loop partial sections 68. The camera 75 is consequently an example of a detection device 69 able to simultaneously determine the position of several material webs 65 in the storage device 60.

The function of the installation shown in FIG. 1, particularly the storage devices 16, 19 in each case equipped with the double suction belt, is initially explained in exemplified manner hereinafter for the case that the web delivery speed from the film supply 15 essentially corresponds to the web reception speed of the collecting device 20 and is substantially uniform, whilst the film accelerating means 17 produce the above-described forward-reverse movement of the stamping film web with the film acceleration phases. The speed of the conveyor belts in the drawing-in direction is preferably so adjusted that both on the introduction side and on the removal side the driving surface of a suction belt has an excess speed compared with the film, so that static friction is not formed between the stamping film web and the conveyor belt and instead working takes place with slip in the sliding friction area. This requires a film-protecting, gentle, jerk-free pulling of the pulling devices on the stamping film web in the drawing-in direction. In the phases when the feed-side web speed at a store exceeds the discharge-side speed, the store will fill, in that the free loop section migrates upwards in the direction of the associated sensor means. During said migration the shape of the free loop partial section determined by the inherent tension of the film web and the suction belt spacing remains substantially unchanged, whereas the parallel-running, straight legs of the loop section are lengthened. Independently of the total length of the loop, the straight legs are held over their entire length by the suction belts and are therefore actively kept apart with a spacing corresponding to that of the facing driving surfaces. Unlike in the case of conventional vacuum stores, the loop partial section is guided and held in positionally reliable manner over most of its length, with the exception of the free loop section, so that in particular a contact between the loop legs, e.g. due to electrostatic attraction forces, is reliably prevented. However, the unguided, free loop partial section is quietly and in flutter-free manner kept between the suction belts and can be used as a readily detectable reference surface for the spacing measurement by means of the sensor means directed onto it. The positionally reliable web guidance can be ensured without special sealing measures, such as are necessary with vacuum stores. It is in particular possible without effort and expenditure to change to film webs of different widths, because there is no need to provide web-limiting side walls.

In the case of installations having a uniform, supply-side feed speed and/or uniform, collecting-side discharge speed, the total drawing-in length of the store determining the storage capacity of the film store must be established in such a way that there can be no store overfilling or complete emptying of the store. The store dimensions can be reduced, in that the filling level and/or filling or emptying speed of a store can be monitored by a sensor means 50 and is e.g. the unwinding speed of the winding-off storage roll 15 is controlled as a function of the filling level and/or filling speed. A proximity sensor is particularly advantageous for this purpose, because not only the absolute fill heights, given by the (vertical) position of the free loop partial section can be detected, but also through the observation of the time sequence of the spacing, in particular also the filling or emptying speeds. Thus, when the filling level rapidly approaches an extreme point, e.g. the feed speed can be slowly reduced or increased in good time instead of as in the conventional situation where the control process is only initiated on reaching a filling level extreme. The "anticipatory" control also makes it possible to e.g. use larger or heavier film supply rolls, which as a result of inertia can only be slowly accelerated. Larger film supplies mean less machine shut-down periods, because a roll change has to be carried out less frequently. A proximity sensor acting in the store longitudinal direction is advantageous compared with conventional position sensors acting in the store transverse direction, because a single sensor is sufficient for detecting both filling level maxima and filling level minima.

What is claimed is:

1. A storage device for receiving a loop section of at least one moving, flexible material web, between a feed area upstream of the storage device, in which the at least one material web is moved at a feed web speed, and a downstream discharge area, in which the material web is moved at a discharge web speed at least periodically differing from the feed web speed, wherein the storage device has on the feed side a first pulling device for drawing the material web into the storage device and on the discharge side a separate, second pulling device for pulling the material web into the storage device.

2. The storage device according to claim 1, wherein at least one of the first pulling device and the second pulling device has at least one planar driving surface movable in a drawing-in direction and pressure means for the flat pressing of the material web onto the driving surface.

3. The storage device according to claim 1, wherein at least one of the first pulling device and the second pulling device has at least one circumferential conveyor belt with an outer surface, said conveyor belt forming a driving surface with a planar portion of its outer surface.

4. The storage device according to claim 1, wherein the pressure means comprise at least one suction device for sucking the at least one material web onto the driving surface.

5. The storage device according to claim 1, wherein between the first and second pulling devices is provided a fan rail, which has at least one air exit port for an air flow for pressing the at least one material web onto the pulling devices.

6. The storage device according to claim 5, wherein the air flow is laminar.

7. The storage device according to claim 1, wherein the first pulling device and second pulling device have driving surfaces which face one another and run substantially parallel to one another.

8. The storage device according to claim 1, wherein means are provided for adjusting the tensile force brought about on the at least one material web by at least one of the first pulling device and the second pulling device.

9. The storage device according to claim 1, wherein for the detection of a store filling a sensor means is provided, which has at least one proximity sensor for detecting a spacing between a free loop partial section of the loop section and a reference position.

10. The storage device according to claim 9, wherein the sensor means is constructed for detecting a speed change of the store filling.

11. The storage device according to claim 9, wherein the sensor means has at least one transmitter directable onto a free loop partial section for generating at least one of electromagnetic and sound waves.

12. The storage device according to claim 11, wherein the transmitter has at least one laser light source.

13. The storage device according to claim 9, wherein the sensor means is formed by a camera.

14. The storage device according to claim 13, wherein a conveyor belt of the pulling device is transparent and the camera is located on the side of the pulling device remote from the at least one material web.

15. The storage device according to claim 1, wherein said storage device is constructed for storing several parallel, movable material webs and wherein a sensor means has at least one sensor, which for the time-succeeding detection of a store filling in the case of at least two parallel-movable material webs, is movable between corresponding material web areas.

16. The storage device according to claim 1, wherein the first pulling device and second pulling device have driving surfaces which face one another.

17. The storage device according to claim 1, wherein the first pulling device and second pulling device have driving surfaces which run substantially parallel to one another.

18. The storage device according to claim 2, wherein said at least one planar driving surface is sectionwise.

19. The storage device according to claim 2, wherein a speed of the driving surface in the drawing-in direction is higher than the speed of an engaging material web in the drawing-in direction.

20. The storage device according to claim 8, wherein at least one of a suction intensity of a suction device and a movement speed of at least one of said driving surfaces is controllable.

21. The storage device according to claim 11, further comprising at least one receiver for receiving waves reflected by the free loop partial section.

22. The storage device according to claim 21, wherein the receiver has at least one photodiode.

23. The storage device according to claim 21, wherein the transmitter has at least one laser light source and the receiver has at least one photodiode.

24. The storage device according to claim 15, wherein said material webs are independently movable.

25. A storage device used in a stamping device, said storage device for receiving a loop section of at least one moving, flexible material web, between a feed area upstream of the storage device, in which the at least one material web is moved at a feed web speed, and a downstream discharge area, in which the material web is moved at a discharge web speed at least periodically differing from the feed web speed, wherein the storage device has on the feed side a first pulling device for drawing the material web into the storage device and on the discharge side a separate, second pulling device for pulling the material web into the storage device; and said stamping device, with a stamping press, in which a stamping gap is formed between a stamping cylinder and an impression element, and with a conveying device for conveying a stamping film web from a film supply, through the stamping gap to a film collecting device, the conveying device having film accelerating means constructed in such a way that at least during a stamping interval the film web is moved at the same speed as the material web to be stamped through said stamping gap, wherein at least one of: (i) between the film supply and the film accelerating means; and (ii) between the film accelerating means and the film collecting device, is provided at least one storage device.

26. The storage device used in a stamping device according to claim 25, wherein the film accelerating means are constructed for producing a non-uniform movement of the material web.

27. The storage device used in a stamping device according to claim 25, wherein the film supply is controllable with respect to the stamping film delivery rate.

28. The storage device used in a stamping according to claim 26, wherein said non-uniform movement is a forward/reverse movement in which the material web is periodically moved in a reverse direction opposite to a main conveying direction.

29. The storage device used in a stamping device according to claim 27, wherein the film supply further comprises a winding-off storage roll for the stamping film web.

30. The storage device used in a stamping device according to claim 27, wherein the film supply is controllable with respect to the stamping film delivery rate as a function of at least one of the filling level and a speed change in a filling of a storage device downstream thereof.

* * * * *

UNITED STATES PATENT AND TRADEMARK OFFICE

CERTIFICATE OF CORRECTION

PATENT NO. : 6,230,616 B1
DATED : May 15, 2001
INVENTOR(S) : Armin Steuer

It is certified that error appears in the above-identified patent and that said Letters Patent is hereby corrected as shown below:

Claim 28,
Line 1, after "stamping", insert -- device --,

Claim 30,
Line 4, change "the filling level" to -- a filling level --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*